US005860239A

United States Patent [19]

Thalenfeld et al.

[11] Patent Number: 5,860,239

[45] **Date of Patent: *Jan. 19, 1999**

[54] MERCHANDISE DISPLAY HOOK WITH PIVOTING LABEL HOLDER

[75] Inventors: David R. Thalenfeld, Bear Creek, Pa.; Thomas O. Nagel, Blairstown, N.J.

[73] Assignee: Trion Industries, Inc., Wilkes-Barre, Pa.

[ * ] Notice: The term of this patent shall not extend beyond the expiration date of Pat. No. 5,702,008.

[21] Appl. No.: 640,336

[22] Filed: Apr. 30, 1996

[51] Int. Cl.[6] ..... G09F 3/00

[52] U.S. Cl. ..... 40/642.01; 40/666; 211/57.1; 211/59.1; 248/214; 248/231.81

[58] Field of Search ..... 40/642.01, 642.02, 40/661.08, 666; 211/57.1, 59.1; 248/214, 231.81

[56] References Cited

U.S. PATENT DOCUMENTS

| | | | |
|---|---|---|---|
| 4,394,909 | 7/1983 | Valiulis et al. . | |
| 4,540,093 | 9/1985 | Merl et al. . | |
| 4,801,116 | 1/1989 | Blankenship . | |
| 4,821,437 | 4/1989 | Abramson et al. . | |
| 5,088,606 | 2/1992 | Boas . | |
| 5,235,766 | 8/1993 | Fast et al. . | |
| 5,348,167 | 9/1994 | Jensen | 211/57.1 |
| 5,442,872 | 8/1995 | Moser . | |
| 5,456,034 | 10/1995 | Lewis et al. . | |
| 5,702,008 | 12/1997 | Thalenfeld et al. | 211/57.1 |

*Primary Examiner*—Kenneth J. Dorner
*Assistant Examiner*—Andrea Chop
*Attorney, Agent, or Firm*—Schweitzer Cornman Gross & Bondell LLP

[57] ABSTRACT

A merchandise display hook provided with an improved form of pivoting label holder. A label-mounting arm extends above and terminates forwardly of a merchandise display arm. A transversely disposed cross bar is secured to an outer surface portion of the label-mounting arm, spaced from the end extremity thereof, by electric resistance welding. The cross bar provides a pivot mount for a plastic label holding device, with the end extremity of the label mount serving as an abutment stop to limit rearward pivoting movement of the label holder. The cross bar can be so positioned on the label mounting arm as to provide for a normal, slightly upwardly tilted orientation of the label holder, to facilitate viewing. In one embodiment, the outer end of the label mounting arm is bent downwardly, and the cross bar is welded to the downwardly bent portion. In another embodiment, the label mounting arm is straight, and the cross bar is welded to the upper surface thereof, spaced slightly from the outer end face of the arm. The arrangement provides enhanced function, while at the same time achieving desirable manufacturing economies.

7 Claims, 2 Drawing Sheets

MERCHANDISE DISPLAY HOOK WITH PIVOTING LABEL HOLDER

BACKGROUND AND SUMMARY OF THE INVENTION

Display hooks, typically mounted on apertured panel board, slotted panels or the like are in widespread usage for displaying carded merchandise for sale. In many cases, such merchandise display hooks are combined with label-mounting means for presenting product information and pricing in association with the carded merchandise. A common form of such label-mounting means consists of an arm projecting above and generally parallel to a merchandise supporting arm and mounting a label-holding device at its forward extremity, advantageously in a position directly in front of the outer end of the merchandise display hook. The label-holding device, in such cases, serves an additional function as a means for guarding the outer end of the display hook element against accidental contact.

One of the known label-mounting means for this purpose comprises a wire-like element extending outward, above the merchandise support, and terminating at its outer extremity in a welded-on cross bar element. The cross bar element serves as a pivoting support for a plastic label holder, allowing the label holder to hang downward in front of the outer end of the merchandise support. The pivoting action of the label holder facilitates product removal from the associated product support. If a product being withdrawn forwardly from its display hook engages the plastic label holder, the holder can simply pivot upward out of the way as necessary to allow the product to clear. An additional advantage of pivoting label holders in general is that, with respect to product items displayed at a low level, viewing of the product information and pricing is facilitated by allowing the customer to simply reach down and tilt the label holder upwardly, rather than having to bend or crouch to read the contents of the label.

The present invention is directed to a merchandise display hook of the general type described above, including a pivoted label holder arrangement, which is both improved with respect to known constructions and is at the same time capable of more economical manufacture. To this end, the device of the invention includes a cross bar element, for pivotal support of a label holder, which is not mounted at the end extremity of its support arm, as in devices of known construction, but is welded to an upper surface portion of the support arm, at a position closely adjacent to but nevertheless displaced from the end extremity thereof. In one form of device according to the invention, the outer end extremity of the label support element is bent downward, typically at an angle of less than 90°, and defines a short label positioning element at the outer end of the label support. The cross bar element is fixed by resistance welding to an upper-outer surface portion of the downwardly angled positioning element to provide a pivotal mount for a plastic label holder. When the label holder is mounted on the cross bar, the positioning element, extending downwardly and forwardly beyond the cross bar, serves as an abutment, to limit rearward pivoting movement of the label holder. This not only prevents backward tilting of the label holder, as can occur with existing designs, but additionally allows for the merchandise display hook to be designed to provide a slight upward tilt to the label holder for more convenient viewing by prospective customers.

In an alternative form of device according to the invention, the label support element is straight, and the cross bar element is fixed by resistance welding to the upper surface thereof, preferably spaced slightly back from the end extremity of the label support. The outer end face of the label support serves, in this embodiment of the invention, as an abutment stop to prevent rearward pivoting of the plastic label holder.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figures 1, 5:
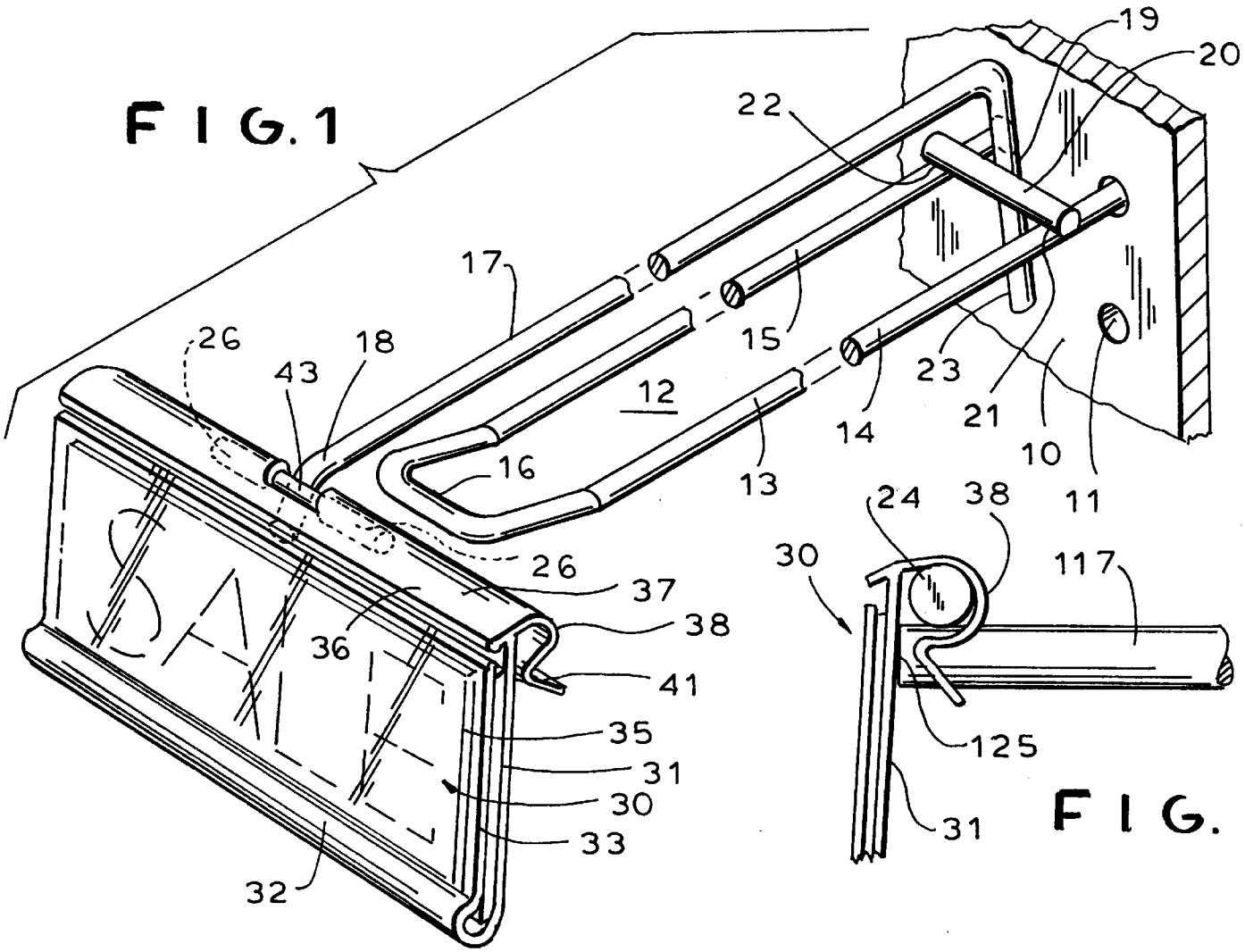
FIG. 1 is a perspective view of one preferred embodiment of a merchandise display hook according to the invention.
FIG. 5 is a fragmentary side elevational view of a second preferred embodiment of the invention.
Figure 3:
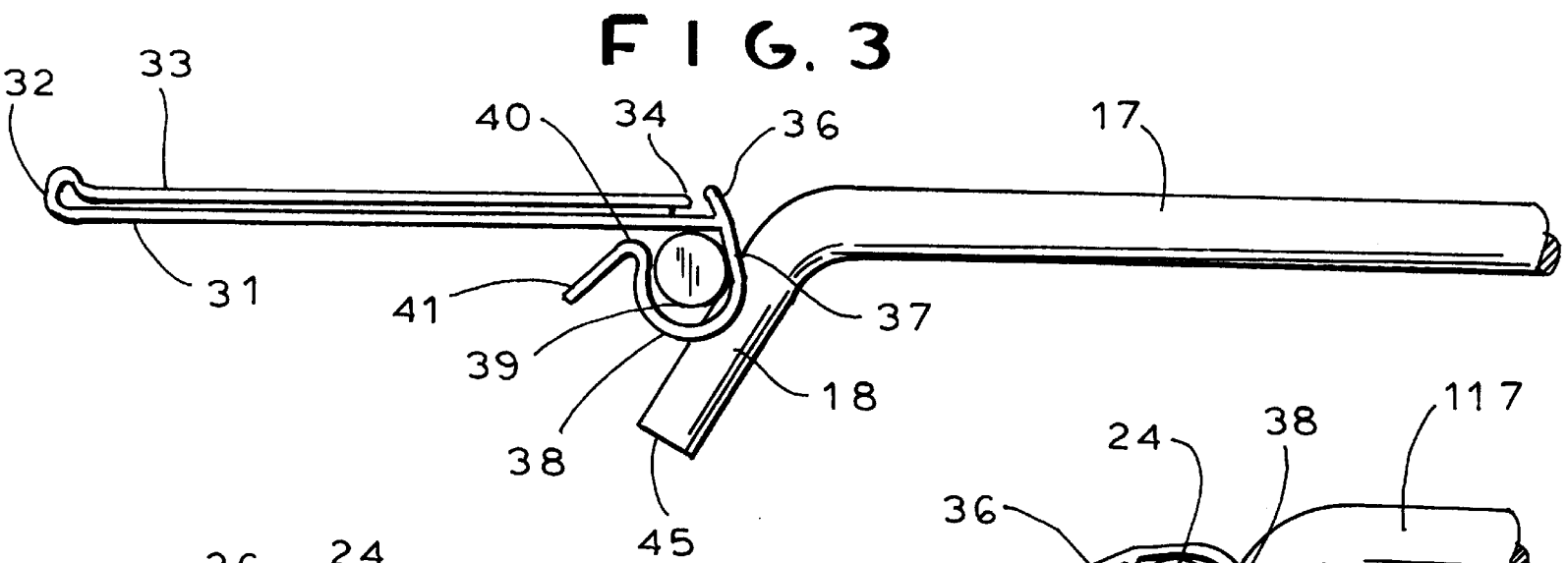
FIG. 3 is a fragmentary side elevational view, similar to FIG. 2, illustrating the label-holding device in an upwardly pivoted position.

Referring now to the drawing, the reference numeral 10 designates a section of apertured panel board provided with a grid of openings 11. Conventionally, the openings 11 are provided over the entire surface of the panel 10 and are spaced uniformly, both horizontally and vertically. A merchandise display hook 12 is conventionally provided with mounting lugs (not shown) which are inserted through an adjacent pair of apertures 11 in the board 10 in order to support the merchandise hook 12 in the manner illustrated in FIG. 1, with operative portions of the display hook extending outward from the face of the panel board.

In the form of the invention illustrated in FIGS. 1–4, the hook 12 includes a merchandise supporting element 13 in the form of a loop hook. The loop hook comprises outwardly extending parallel wire supports 14, 15, joined at the outer end by a U-shaped bend 16. L-shaped mounting lugs (not shown) are provided at the innermost end extremities of the wire sections 14, 15. A label supporting arm 17 extends above and generally parallel to the merchandise support 13, with the outer end portion 18 of the arm 17 positioned slightly beyond and slightly above the end extremity 16 of the merchandise supporting loop hook 12. At its inner end, the label support 17 has a downwardly extending leg 19 which is welded to a transverse cross bar 20. The cross bar 20 is in turn welded to the respective legs 14, 15 of the loop hook, as indicated at 21, 22. The lower end extremity 23 of the leg 19 projects below the level of the loop hook and is arranged to engage the front surface of the apertured panel 12, serving as a support to maintain the generally horizontal orientation of the merchandise support 12.

In the embodiment of the invention shown in FIGS. 1–4, the outer end portion 18 of the label support 17 is bent downward at a substantial angle, preferably about 60° or so to the horizontal, and in preferred constructions at an angle less than 90°. A label supporting cross bar 24 is welded to the outer surface of the end portion 18, at a point spaced above and rearwardly of the outer end face 25 of the wire end section 18. As shown particularly in FIGS. 1 and 4, the cross bar 24 is mounted symmetrically on the wire section 18, with end portions 26 thereof, extending laterally on each side.

Whereas in accordance with prior knowledge, a label supporting cross bar element, such as the element 24, is welded directly to an end face of the straight wire section 17, it is a feature of the present invention that the cross bar is welded to an outer surface of the wire section 17. One of the advantages of this arrangement is that the welding procedure, which is typically electric resistance welding, is much simpler and more reliable, when welding the cross bar to the outer cylindrical surface of the wire, than when welding it to a flat end face of a wire. Significant manufacturing economies are realized through the easier and more reliable welding procedure, when welding to the outer cylindrical surface. Among other things, there is less wastage through failure to meet quality control standards, which are more difficult to achieve consistently when attempting to weld the cross bar to an end face of the wire.

Mounted on the cross bar 24 is a plastic label holder, generally designated by the reference numeral 30. The label holder may in large part be of known design and construction. It is preferably of extruded or coextruded semi-rigid, plastic construction and comprises a flat back panel 31 joined along a bottom edge 32 with a clear front panel 33. The front and back panels 33, 31, and the bottom connection 32 are so arranged that the front panel tends to close elastically against the front face of the back panel 31. However, by pressing rearwardly against the bottom portion 32, the upper lip 34 of the front panel can be sprung forward from the back panel 31 to accommodate the placement and retrieval of product information and pricing labels 35.

Desirably, a forwardly projecting guard flange 36 is provided along the upper edge of the back panel 31, to normally overlie the upper edge 34 of the front panel.

A hinge-forming flange 37 projects rearwardly from the upper edge of the back panel 31 and includes a U-shaped retaining clip portion 38 defining a forwardly facing U-shaped recess 39 of a size to receive the cross bar element 24. At its lower edge extremity 40, the U-shaped flange portion 38 is bent sharply downward and rearward, and supports an integral, downwardly divergent guide flange 41. The guide flange 41 is angled downwardly at about 45° with respect to the plane of the back panel 31 and extends for a sufficient distance to provide a relatively wide entrance 42 through which the cross bar 24 may be pressed when installing the label holder on the cross bar. Thus, by placing the guide flange 41 in contact with a cross bar 24 and pressing downward on the top of the retaining flange 37, the lower portion of the retaining flange will be cammed open by the guide flange 41. As soon as the cross bar 24 enters the chamber 39, the retaining flange 37 elastically closes to the position shown in FIGS. 2 and 3, so that the label holder is reliably connected to the cross bar 24 while being free to pivot with respect thereto.

Figure 4:
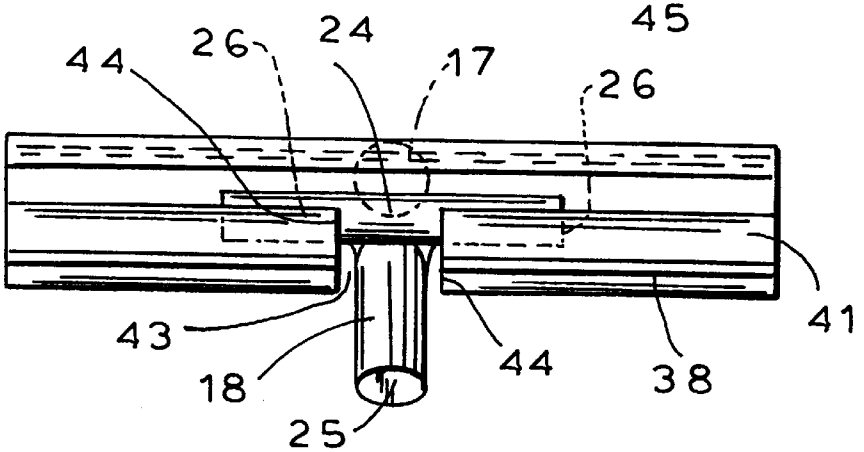
FIG. 4 is a fragmentary front elevational view of the device as shown in FIG. 3.

As shown in FIGS. 1 and 4, the retaining flange portions 37, 38, and the guide flange 41, are slotted at 43, in the center of the label holder, so that inner side edges 44 of the slotted portion straddle the wire end section 18, and serve to maintain the label holder properly centered with respect to the label support arm 17.

Figure 2:
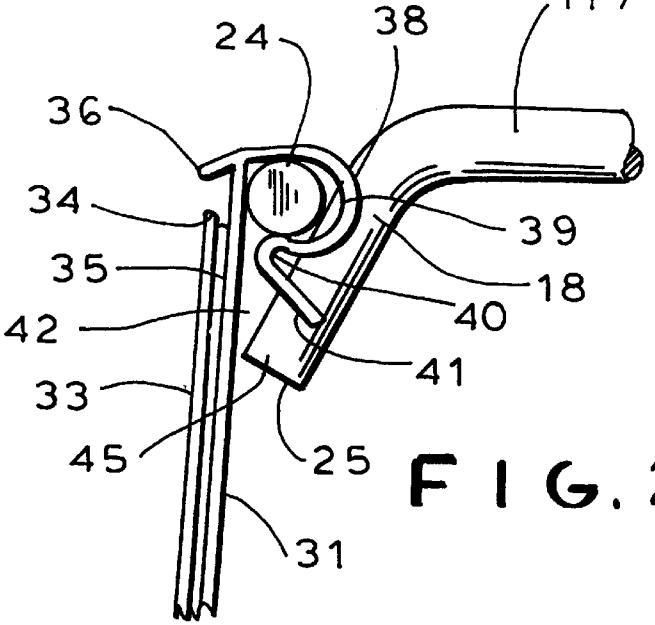
FIG. 2 is an enlarged, fragmentary side elevational view, illustrating front portions of the display hook of FIG. 1, showing a label-holding device in a normal or rest position.

As shown particularly in FIG. 2, the length of the downwardly directed outer end section 18 of the label support 17, the angle at which it is directed, and the distance the cross bar 24 is spaced from the end face 25, are all arranged such that, when a label holder is installed on the cross bar 24, the lower front edge 45 of the wire section 18 engages the back surface of the label holder back panel 31, to position the label holder by limiting the rearward pivoting movement thereof. Preferably, and as illustrated in FIG. 2, the forwardmost surface portions of the cross bar 24 lie slightly behind a vertical plane contacting the forward corner extremity 45 of the wire end section 18. The arrangement is such that the flat panels 31, 33 of the label holder tilt slightly upward with respect to vertical, to facilitate reading of the label holder by a customer.

In the modified form of the invention shown in FIG. 5, the label support arm 117 is straight, and a cross bar element 24 is resistance welded to its upper surface, a short distance back from the front face 125 of the support arm. The arrangement is such that, when the label holder 30 is attached to the cross bar, the end surface 125 of the label support arm engages the back panel 31 of the label holder and serves to limit rearward tilting of the label holder in the desired manner.

The described arrangement is particularly desirable, as compared to the conventional arrangement of mounting the cross bar 24 directly to the end face of a support wire 17. The conventional arrangement, in addition to resulting in increased difficulty and expense in the manufacturing stage, allows the label holder to swing to a rearwardly inclined position where, at least in the lower levels of the display rack, the labels can become difficult for customers to read. In this respect, it will be seen in FIG. 2, for example, that the pivot center of the label holder is located a short distance behind the back panel 31 such that the label holder, by the natural action of gravity, will tend to pivot to a slightly rearward orientation when freely supported on a pivot rod. With the device of the present invention, such tendency is counteracted by the projecting lower end of the wire end section 18, which serves as an abutment stop for limiting rearward pivoting motion of the label holder. Of course, the label holder can be freely pivoted in a forward direction, to accommodate loading and removal of product from the display hook.

It should be understood, of course, that the specific form of the invention herein illustrated and described is intended to be representative only. In this respect, the specific form of the merchandise display hook employing the new label-mounting feature may take any of a variety of forms. Likewise, the plastic label holder itself may be constructed in various ways consistent with the present invention. Accordingly, reference should be made to the following appended claims in determining the full scope of the invention.

We claim:

1. A merchandise display hook with pivoting label holder, comprising, (a) an outwardly extending unitary, integral label holder arm, said label holder arm being comprised of a single length of metal wire of substantially cylindrical cross section and having an end face, (b) means associated with an inner end of said label holder arm for mounting said arm on a support structure, (c) a metal wire cross bar member of substantially cylindrical cross section electrically resistance welded tangentially directly to an upper surface of an outer end of said unitary, integral label holder arm adjacent but spaced inwardly from said end face, for the support of a label holder, (d) a label holder mounted on said label holder arm and having a label panel for retaining a product information label, (e) said label holder including a pair of spaced-apart cross bar engaging clip portions engaging said cross bar on opposite sides of said label holder arm, (f) said cross bar engaging clip portions and said label holder being freely pivotally mounted on said cross bar to accommodate easy product removal from a position below said label holder arm, (g) outer end portions of said label holder arm forming a label holder positioning support engageable with a back portion of said label panel to support said panel in an easily visible angular orientation and to prevent rearward pivoting movement of said label holder beyond said easily visible angular orientation while accommodating free pivoting movement of said label holder in a forward direction, and (h) a forwardmost surface portion of said cross bar being behind a vertical plane contacting a forward extremity of said label holder positioning support such that said label holder, when mounted on said cross bar, has an upwardly tilted angular orientation.

2. A merchandise display hook with pivoting label holder according to claim 1, wherein (a) said label holder arm has a downwardly directed outer end section, and (b) said cross bar member is fixed to said downwardly directed end section on an outer surface portion thereof.

3. A merchandise display hook with pivoting label holder according to claim 1, wherein (a) said label holder comprises a back panel formed of semi-rigid, resiliently deflectable plastic material, and (b) said cross bar engaging clip portions each comprise an integral section of said semi-rigid plastic material extending first rearwardly from said back panel and then downwardly and then forwardly toward said back panel to form an enclosure for said cross bar member, (c) said clip portions further including integral, downwardly and rearwardly extending guide flanges for engaging said cross bar and, upon downward urging of said label holder, forcing said clip portions to open along the bottom to accept said cross bar member.

4. A merchandise display hook with pivoting label holder according to claim 3, wherein (a) said cross bar engaging clip portions extending the full width of said label holder except for a space provided between them at the center of said label holder, (b) said space being of a width slightly greater than the width of said label holder arm, whereby to hold said label holder in a centered position while accommodating free upward pivoting movement of said label holder.

5. A merchandise display hook with pivoting label holder according to claim 1, further comprising (a) a merchandise supporting arm extending outwardly below said label holding arm.

6. A merchandise display hook with pivoting label holder according to claim 5, wherein (a) said merchandise supporting arm and said label holder arm being joined at their respective inner ends for mounting on said support structure.

7. A merchandise display hook with pivoting label holder according to claim 6, wherein (a) said merchandise supporting arm and said label holder arm are permanently joined.

* * * * *